United States Patent [19]

Reid

[11] 4,307,368

[45] Dec. 22, 1981

[54] ELECTRIC FUSE HAVING GAS EVOLVING MEANS FOR LIMITING BURNBACK

[75] Inventor: Clyde D. Reid, S. Hampton, N.H.

[73] Assignee: Gould Inc., Rolling Meadows, Ill.

[21] Appl. No.: 189,519

[22] Filed: Sep. 22, 1980

[51] Int. Cl.[3] ..... H01H 85/42

[52] U.S. Cl. ..... 337/279; 337/281

[58] Field of Search ..... 337/158, 159, 273, 276, 337/279, 281

[56] References Cited

U.S. PATENT DOCUMENTS 2,964,604 12/1960 Jacobs, Jr. et al. ..... 337/159

4,179,678 12/1979 Perreault ..... 337/279

*Primary Examiner*—George Harris

*Attorney, Agent, or Firm*—Erwin Salzer

[57] ABSTRACT

The process of circuit interruption by an electric fuse can be initiated either by a protracted overload, or by a major fault current of large proportions. This invention is concerned with the latter kind of fault currents.

A substantially U-shaped gas-evolving structure is inserted between parallel rows of fusible elements. The two parallel arms of that structure are positioned close to the terminal elements of the fuse. A tie member interconnecting the two arms is positioned substantially out of the arcing zone and parallel to a generatrix of the fuse casing. On occurrence of a major fault current, the gas evolved from the arms protects the terminal elements of the fuse. It also tends to quench the follow current, i.e. the current which flows through the hot fulgurite after a successful interruption of a major fault current.

7 Claims, 4 Drawing Figures

ELECTRIC FUSE HAVING GAS EVOLVING MEANS FOR LIMITING BURNBACK

BACKGROUND OF THE INVENTION

The most pertinent art known on which this invention is based is U.S. Pat. No. 2,964,604; 12/13/60 to P. C. Jacobs, Jr. et al for CURRENT-LIMITING FUSES HAVING COMPOUND ARC-VOLTAGE GENERATING MEANS. There are numerous other patents following the basic teachings of this patent, but their discussion in this context does not appear to be necessary because the above patent includes all the basic teachings on which subsequent patents are based.

The above patent to Jacobs et al refers to a fuse whose fusible element has a plurality of serially related points of reduced cross-section where arc initiation occurs simultaneously at severe, or major, fault currents, or short-circuit currents. The fusible element is embedded in a pulverulent arc-quenching filler, particularly quartz sand. Some points of reduced cross-section are sandwiched between plates of gas-evolving material such as, for instance, a synthetic-resin-glass-cloth laminate and other points of reduced cross-section are not sandwiched between such plates. The synthetic resin of the plates is preferably melamine. The gas-evolving plates of this kind expose some of the points of reduced cross-section, where arc initiation occurs, to the action of the pulverulent arc-quenching filler, and shield other points of reduced cross-section, where arc initiation occurs, from the action of the arc-quenching filler. Where the points of reduced cross-section of the fusible element are exposed, a relatively high arc voltage is generated. Where the points of reduced cross-section are shielded, the rate of rise of the arc voltage will be less steep than at the points of reduced cross-section where the arc is fully exposed to the action of the arc-quenching filler.

Since the shielding material is gas-evolving, gas evolving from it will play a significant part in the process of arc-extinction. The gas-evolution will increase the pressure in the fuse casing, and increased pressure is helpful in interrupting an arc discharge.

Gas-evolution from a gas-evolving material may also be used to blow an arc in a given direction, where there is less danger of damage by the arc than when the direction of its movement were uncontrolled.

I have also found that fasteners heretofore used to affix a pair of gas-evolving plates to a fusible element can be dispensed with if the gas-evolving plate or the like is sufficiently thick, and the gas-evolving plate or the like is loosely inserted in the gap formed between contiguous fusible elements, or fuse links.

SUMMARY OF THE INVENTION

The invention pertains to the class of electric fuses comprising a casing of electric insulating material; a pair of terminal elements closing the ends of said casing; a pulverulent arc-quenching filler inside said casing; parallel rows of fusible elements embedded in said arc-quenching filler conductively interconnecting said pair of terminal elements; each of said fusible elements defining a plurality of serially arranged points of reduced cross-section; and means for controlling the arc-voltage at predetermined points only of said rows of fusible elements.

The improvement according to the present invention comprises a pair of arms of gas-evolving materials located inside said casing, each in close proximity to one of said pair of terminal elements, tending to prevent an arc by the gas blast evolving therefrom from reaching said pair of terminal elements, a tie member of the same material as said pair of arms interconnecting said pair of arms and forming jointly with said pair of arms a substantially U-shaped structure, said structure being inserted between adjacent rows of said fusible elements and the web portion of said U-shaped structure being arranged in a direction longitudinally of said casing and off the center and close to the wall thereof.

DESCRIPTION OF PREFERRED EMBODIMENT

Figure 1:
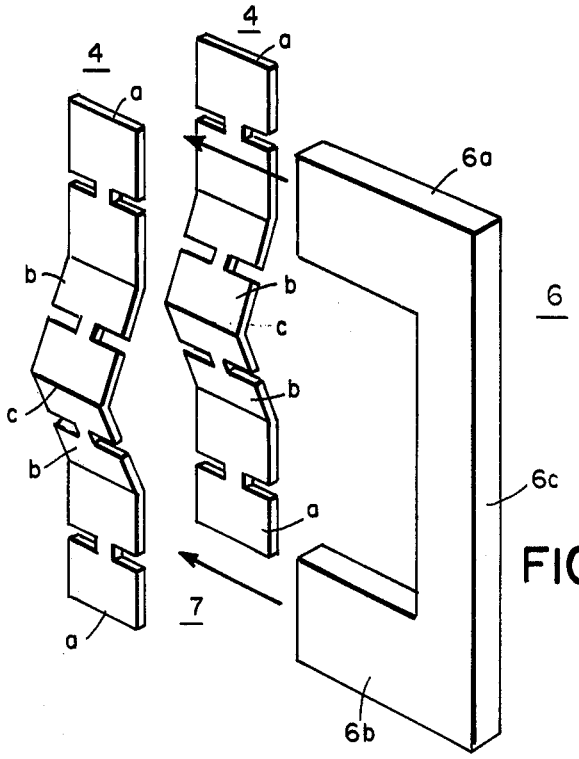
FIG. 1 is an isometric view of two parallel rows of fusible elements and of a structure of gas-evolving material in the process of being inserted into the gap formed by said two rows of fusible elements.

Referring now the drawings, reference numeral 1 has been applied to indicate a pair of terminal plugs closing the ends of casing 2. Terminal plugs 1 are electroconductive, while casing 2 is of an electric insulating material such as, for instance, a synthetic-resin-glass-cloth laminate. Casing 2 and plug 1 are tied together by pins 3 projecting radially through casing 2 into plugs 1 or, to be more specific, the radially inner ends of pins 3 project into plug terminals 1, while the radially outer ends of pins 3 end in casing 2. The axially inner end surfaces 1*a* of terminal plugs 1 are provided with parallel grooves 1*b* into which the ends of fusible elements 4 enter. They are there conductively connected by soft solder joints (not shown) to terminal plugs 1. Casing 2 is filled with a pulverulent or granular arc-quenching filler 5, preferably quartz sand. Only the portions of arc-quenching filler 5 immediately adjacent the internal wall of casing 2 have been shown for reasons of greater clarity.

As shown in FIG. 1 a substantially U-shaped structure of gas-evolving material, generally indicated at 6, is in the process of being inserted into a gap, generally indicated at 7, formed between a pair of fusible elements, generally indicated at 4.

Figure 4:
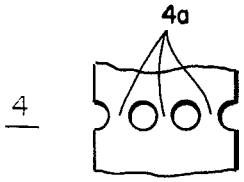
FIG. 4 shows a portion of a modified fusible element.
Figure 3:
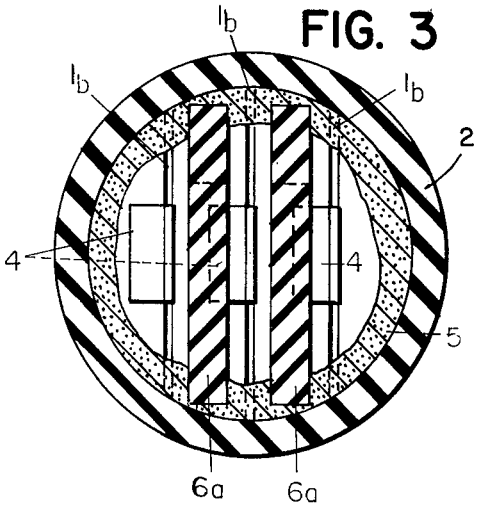
FIG. 3 is a section along III—III of FIG. 2.

The structure of FIGS. 3 and 4 comprises three fusible elements 4 rather than merely two such elements.

Figure 2:
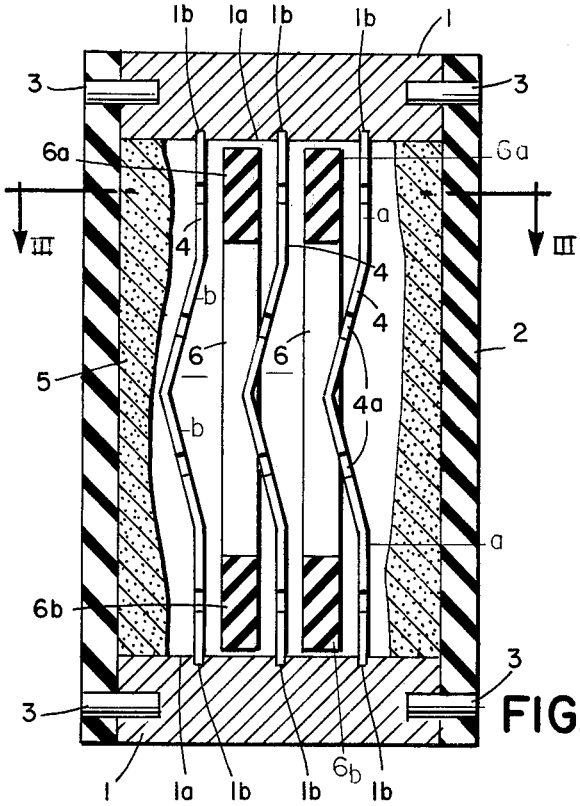
FIG. 2 is essentially a vertical section through a fuse according to the present invention.

The current path through the structure of FIGS. 2 and 3 is as follows:

Upper terminal plug 1, fusible elements 4 in parallel, lower terminal plug 1.

As shown in FIG. 1, each fusible element 4 includes two planar axially outer portions a which are parallel to each other and parallel to the axially outer portions a of the adjacent fusible element. Each fusible element 4 further includes two axially inner converging portions b intersecting at line c. Each of portions a and b includes a point of restricted cross-section, but all of the points of restricted cross-section are spaced from the intersections between planes such as, for instance, planes a and b, or planes b and b. This geometry of the fusible elements 4 greatly increases their cycling ability, i.e. their ability to withstand relatively frequent or repetitive changes in load conditions without breaking, or suffering other physical damage.

In the structure shown in FIGS. 2 and 3 the geometry of the fusible elements 4 is the same as that shown in FIG. 1, except that each serially arranged point of reduced cross-section has been replaced by a plurality of parallel connected points of reduced cross-section as clearly shown in FIG. 4.

As shown in FIGS. 1 to 3, inclusive, the part 6 of gas-evolving insulating material includes a pair of parallel arms *6a,6b*. Arms *6a,6b* are each arranged in close proximity to one of terminal elements 4, i.e. arm *6a* in close proximity to upper plug 1, and arm *6b* in close proximity to lower plug 1. When the arcs burn back along fusible elements 4 to the region of arms *6a,6b*, the gas blasts evolving from arms *6a,6b*, tend to prevent the arcs from reaching terminal plugs 4. While this process of stopping the arcs is of relatively complex nature, it comprises essentially a stopping of the axially outward flow of ionized gases by an axially inward flow of deionized gas evolved from arms *6a,6b*. This reversal of the flow of gas which is now from plugs 1 toward the center of the fuse is accompanied by a simultaneous deionization of the products of arcing.

Arms *6a,6b* are interconnected by a tie member *6c* of the same material as arms *6a,6b*, so that arms *6a,6b* and tie member *6c* form jointly a substantially U-shaped structure as shown in FIGS. 1–3. This structure is inserted between a pair of adjacent rows of fusible elements 4 without use of fastener means for attaching said structure to said fusible elements.

The thickness of structure *6a,6b,6c* should only be slightly less than the spacing between said rows of fusible elements 4, thus providing a spacer between the axially outer ends of the elements. There is no danger that the presence of such massive parts of gas-evolving material produce an excess pressure in casing 2 because parts 6 may contain the right amount of gas-evolving substances and of non-gas-evolving substances. As far as gas-evolving materials are concerned, structure 6 may preferably comprise as components melamine resin and aluminum trihydrate. To reduce the amount of pressure generated by these chemicals, non-gas-evolving media may be added to the gas-evolving substances.

Fusible elements 4 include serially arranged points of reduced cross-sectional area of which each point may either include one single current path (FIG. 1), or a plurality of current paths in parallel (FIG. 4). It is at these axially outermost points of fusible elements 4 where arms *6a,6b* should cross over fusible elements 4 to be acted upon by the arcs initiated at these points. The tie member *6c* should extend substantially parallel to the axis of casing 2 and close to the inner wall thereof. Arms *6a,6b* should be arranged close to the internal wall of the casing 2 so that unit 6 is substantially immobilized by the latter.

The U-shaped members 6 define an aperture into or through which the peaks of the fusible elements, or element 4, may project. This allows the use of the cycling-proof fusible elements 4 jointly with arc-limiting bodies 6 because the latter form passages for the converging portions b,b of fusible elements 4.

I claim as my invention:

1. An electric fuse comprising a casing of electric insulating material; a pair of terminal elements closing the ends of said casing; a pulverulent arc-quenching filler inside said casing; parallel rows of fusible elements embedded in said arc-quenching filler conductively interconnecting said pair of terminal elements; each of said fusible elements defining a plurality of serially arranged points of reduced cross-section, and means for controlling the arc voltage at predetermined points only of said rows of fusible elements wherein the improvement comprises a pair of arms of gas-evolving material located inside said casing each in close proximity to one of said pair of terminal elements tending to prevent an arc by the gas-blasts evolving therefrom from reaching said pair of terminal elements, a tie member of the same material as said pair of arms interconnecting said pair of arms and forming jointly with said pair of arms a substantially U-shaped structure, said structure being inserted between a pair of adjacent rows of said fusible elements and the web portion of said U-shaped structure being arranged in a direction longitudinally of said casing and off the center and close to the wall thereof.

2. An electric fuse as specified in claim 1 wherein the thickness of said structure is only slightly less than the spacing between said rows of fusible elements.

3. An electric fuse as specified in claim 1 wherein said pair of arms cross over the axially outermost points of reduced cross-section of said fusible elements.

4. An electric fuse as specified in claim 1 wherein said rows of fusible elements include flat coplanar axially outer end portions and flat center portions converging from said axially inner ends of said end portions and projecting into the cavity defined by said substantially U-shaped structure.

5. An electric fuse as specified in claim 1 wherein said substantially U-shaped structure comprises the components of melamine resin and aluminum trihydrate.

6. An electric fuse comprising a casing of an electric insulating material; a pair of terminal elements closing the ends of said casing; a pulverulent arc-quenching filler inside said casing; parallel rows of fusible elements having serially related points of reduced cross-section embedded in said arc-quenching filler conductively interconnecting said terminal elements; and means controlling the arc-voltage at discrete points of said fusible elements remote from the center thereof, wherein the improvement comprises a member of gas-evolving material having a first portion arranged substantially in axial direction of said casing and a pair of second portions forming an integral part of said first portion and angularly related to said first portion, said pair of second portions having a spacing less than the spacing of said pair of terminal elements and overlapping said fusible elements, said member being loosely inserted between said rows of fusible elements.

7. An electric fuse as specified in claim 6 wherein the thickness of said member of gas-evolving material is but slightly less than the spacing between parallel rows of fusible elements.

* * * * *